United States Patent [19]

Hubbard

[11] Patent Number: 4,807,758

[45] Date of Patent: Feb. 28, 1989

[54] TOTE BOX FOR REPRODUCTION APPARATUS

[75] Inventor: Charles R. Hubbard, Spencerport, N.Y.

[73] Assignee: Eastman Kodak Company, Rochester, N.Y.

[21] Appl. No.: 138,464

[22] Filed: Dec. 28, 1987

[51] Int. Cl.[4] ..... B65D 6/04

[52] U.S. Cl. ..... 206/555; 206/557

[58] Field of Search ..... 206/555, 449, 453, 557, 206/822

[56] References Cited

U.S. PATENT DOCUMENTS

| | | | |
|---|---|---|---|
| 1,867,738 | 7/1932 | Fraser . | |
| 2,100,720 | 11/1937 | Page . | |
| 3,704,791 | 12/1972 | Young, Jr. | 206/555 |
| 4,134,672 | 1/1979 | Burlew et al. . | |
| 4,473,425 | 9/1984 | Baughman et al. . | |
| 4,630,731 | 12/1986 | Albery | 206/555 |
| 4,696,399 | 9/1987 | Windorski | 206/555 |

OTHER PUBLICATIONS

Kodak Ektraprint Copy Tray.

*Primary Examiner*—Joseph Man-Fu Moy
*Attorney, Agent, or Firm*—Leonard W. Treash

[57] ABSTRACT

A tote box for discrete sheets from a reproduction apparatus, such as an electronic printer, has a bottom wall on which the sheets are stacked. Four side walls project upwardly from the bottom wall, and handles on two opposite side walls can be grasped by a person to lift and remove the tote box loaded with sheets from the reproduction apparatus. When sheets are delivered face down into the tote box with the first page facing downwardly, the entire stack needs to be inverted as it is removed from the box. In order to unload and invert the sheets, the tote box is turned first ninety degrees onto the back wall of the box and then, by grasping handholds formed in the bottom wall, the box is turned another ninety degrees to completely invert the box, thereby leaving the stack of sheets on a support with the first sheet facing upwardly. The box is removed from the stack of sheets using the handholds on the bottom of the box.

7 Claims, 3 Drawing Sheets

TOTE BOX FOR REPRODUCTION APPARATUS

BACKGROUND OF THE INVENTION

The present invention relates to improvements in a tote box or tray for reproduction apparatus, particularly electronic printers which produce large quantities of discrete copy sheets and deliver the copies in page sequence order beginning with page 1 of the set of copy sheets.

It is known to provide electrographic reproduction apparatus with finishers that receive copy sheets fed seriatim from the reproduction apparatus to the finisher for stacking on a tote tray or the like. Apparatus of this general type is disclosed in commonly assigned U.S. Pat. No. 4,134,672, entitled Copies Finisher for an Electrographic Reproducing Device, issued Jan. 16, 1979 in the names of L. E. Burlew et al. In the finisher disclosed in that patent sets of copy sheets are fed seriatim to a hopper where they are accumulated and jogged to form an aligned set of copy sheets. The set of copy sheets is then grasped by an arm, removed from the hopper and swung into a position over a tote tray where they are released and thus delivered onto the bottom surface of the tote tray. An elevator mechanism gradually lowers the tote tray as additional sets of copy sheets are delivered to the tray. When a job is completed the tote tray can be removed and the sets of copy sheets unloaded from the tray. Unloading of the tote tray as disclosed in the Burlew et al patent is relatively easy for two reasons. First of all, the finisher is primarily designed for forming booklets that are stacked in the tray, and the booklets can be unloaded individually or in groups that are small enough to be conveniently handled by the operator. In other words, the entire stack of booklets in the tray is not necessarily unloaded at once. In addition, the booklets are delivered to the tray with the first page of each booklet facing upwardly, so that the booklets do not need to be inverted when they are unloaded.

Commonly assigned U.S. Pat. No. 4,473,425, entitled Binding Apparatus and Method, issued Sept. 25, 1984 in the names of R. C. Baughman et al discloses apparatus for forming booklets either by using a finisher as disclosed in the Burlew et al patent or by means of an adhesive binding apparatus. The adhesive binding apparatus also uses a tote tray on which sets of booklets are accumulated and unloaded in the manner described above for the finisher disclosed in the Burlew et al patent. Here, again, the tote tray receives a series of booklets with the top page thereof facing upwardly so that, during unloading, the booklets can be removed individually or in conveniently small groups, and there is no need for inverting the booklets during removal.

The reproduction apparatus disclosed in the Burlew et al patent comprises an electrophotographic apparatus having an optical system for flash exposure of individual sheets with the copy sheets produced leaving the reproduction apparatus with the image facing downwardly and with the finisher being effective to invert the sheets so that they are delivered face up into the tote tray of the finisher. Electrographic apparatus as shown in the Burlew et al patent can be modified to provide electronic input, instead of an optical system, and thus form a printer for producing copies directly from a computer or other electronic apparatus. In such case the copy sheets from the printer may be inverted by means of a J-type inverter, for example, as known in the art. Thus the output to a tote tray as shown in Burlew et al will be delivered in page sequence order, beginning with the first page of a document and with the first page reaching the tote tray in a face down orientation with subsequent pages being directly on top thereof and facing downwardly. Also, output from electronic printers may comprise extremely long documents so the tote tray must be able to handle large stacks of discrete sheets, for example, about two or three thousand sheets. Under these circumstances it is important to be able to unload the sheets from the tray conveniently and simultaneously invert the entire stack in a way which is simple for the operator to handle and which assures continuity of the page sequence order of the sheets after inversion of the stack of copy sheets.

SUMMARY OF THE INVENTION

Accordingly, it is an object of the invention to provide an improved tote box for receiving discrete sheets from a printer or the like wherein the tote box can be easily inverted to unload the sheets from the box and simultaneously invert the entire stack of sheets.

A tote box of the invention is adapted to receive a stack of discrete sheets, and then to remove the stack from the box by inverting the box. The box comprises a bottom wall having a surface on which sheets are stacked. The bottom wall has a handhold by which a person can grasp and move the tote box. First and second side walls project upwardly from the bottom wall in generally parallel planes, and a pair of handles are secured to the first and second walls and spaced from the bottom wall. Third and fourth side walls project upwardly from the bottom wall in generally parallel planes that are substantially perpendicular to the first and second walls. The third wall is shorter than the fourth wall with the top of the third wall being sufficiently low to enable sheets to pass above the top of the third wall as they are delivered into the tote box. In operation, a stack of sheets resting on the bottom wall of the tote box and between the other walls can be unloaded by first turning the box approximately ninety degrees so that the box rests on the fourth wall, and then using the handhold on the bottom wall to turn the box another ninety degrees so that the box is completely inverted. Then the box is lifted up and away from the stack.

BRIEF DESCRIPTION OF THE DRAWINGS

In the detailed description of the preferred embodiment of the invention presented below, reference is made to the accompanying drawings, in which.

DETAILED DESCRIPTION OF A PREFERRED EMBODIMENT

Figure 1:
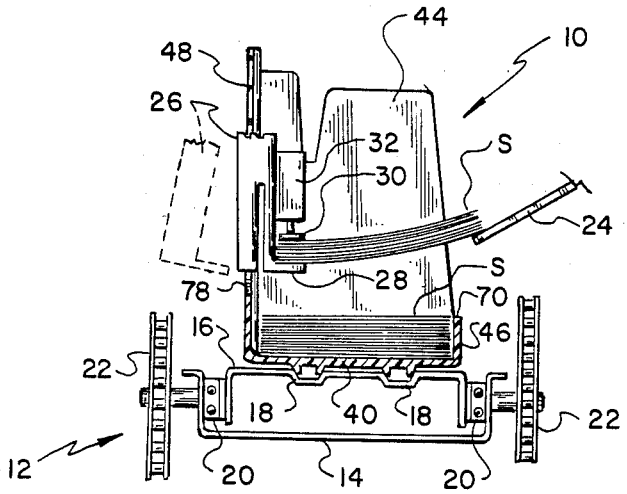
FIG. 1 is a front diagrammatic elevational view showing a preferred embodiment of a tote box of the present invention located in a finisher apparatus.

The tote box of the invention is generally designated 10 and is specifically adapted to be used with a finisher shown in part at 12 in FIG. 1. The finisher 12 can be substantially the same as the one disclosed in detail in the before-mentioned U.S. Pat. No. 4,134,672. Instead of repeating the disclosure of that patent, portions of the finisher are shown in FIG. 1 and the disclosure of U.S. Pat. No. 4,134,672 is hereby incorporated by reference.

The portions of finisher 12 illustrated in the drawings comprise an elevator 14 having a surface 16 on which the tote box rests. Surface 16 has a pair of spaced recesses 18 which serve to locate the tote box on the surface as explained in more detail later. Surface 16 is mounted on a pair of guides 20 to permit movement of the surface 16 relative to the elevator into and out of the finishing apparatus with the tote box thereon. Elevator 14 supports the guides and includes chains 22 which are operatively coupled to a motor (not shown) for raising and lowering the elevator.

Finisher 12 includes a hopper 24 which receives sheets from the reproduction apparatus. The sheets are fed seriatim into the hopper 24 and jogged into alignment. An arm 26 has a fixed jaw 28 at one end thereof. A jaw 30 carried by a cylinder 32 is movable toward and away from the fixed jaw 28. At the appropriate time in the machine cycle the arm 26 is swung from its dotted line position as shown in FIG. 1 to a position where the jaws 28 and 30 straddle a group of sheets S in hopper 24. Then the cylinder 32 is operated to move jaw 30 toward jaw 28 to thereby grip the group of sheets between the jaws. The arm 26 is swung to the solid line position illustrated in FIG. 1 and the cylinder moves jaw 30 away from jaw 28 to thereby release the group of sheets, allowing them to drop into the tote box 10. Stripper arms can be used to remove the group of sheets from the arm as it travels from its solid line position to its dotted line position where it is spaced away from the tote box 10. Reference is made to the before-mentioned U.S. Pat. No. 4,134,672 for a more detailed description of the manner in which the finishing apparatus delivers sheets to the tote box 10.

Referring now to FIGS. 2—5, tote box 10 comprises a bottom wall 40 having a generally flat inner surface. Projecting upwardly from bottom 40 is a plurality of side walls including two end walls 42, 44, respectively and front and back walls 46 and 48, respectively. Walls 42, 44 and 48 are substantially higher than wall 46, and walls 42, 44 are approximately the same height as wall 48. Because wall 48 is higher than the other walls, it can be easily grasped for inverting the box even when the box is substantially full of sheets.

The bottom wall 40 has a pair of elongated, generally rectangular openings 50, 52 located about midway between the front and back walls. The openings 50, 52 are spaced from each other and are adjacent the end walls 42, 44. As explained in more detail later, these openings enable an operator to place the fingers through the openings to grasp the tote box for moving it during removal of sheets from the box.

The bottom surface of bottom wall 40 has four ribs 54 that project downwardly from the bottom surface. The ribs are generally parallel to each other and arranged in pairs. The spacing between the ribs and their arrangement is such that the pairs of ribs will fit into the recesses 18 on platform 16 to thereby locate the tote box on the platform. Ribs 54 preferably extend the full length of the box from end wall 42 to end wall 44. Openings 50, 52 are located between the two pairs of ribs 54.

A pair of handles 60, 62 are secured to or integrally formed with the end walls 42, 44, respectively. Handles 60, 62 are spaced from the bottom wall 40 and preferably are located at the top edge of the respective end walls 42 and 44. Also, the handles are preferably located adjacent the edge of walls 42, 44 that are nearest the front wall 46 of the tote box so that when the box is lifted by the handles there is a tendency for the box to tilt rearwardly about the handles, thereby urging any sheets resting on the bottom of the box toward the back wall 48.

Figure 3:
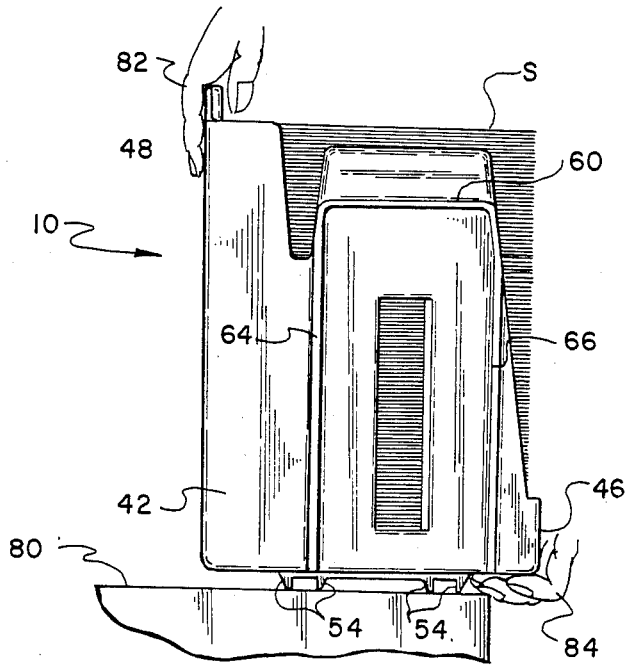
FIGS. 3, 4 and 5 illustrate movement of the tote box from an upright position to an inverted position for emptying a stack of sheets from the tote box.
Figure 2:
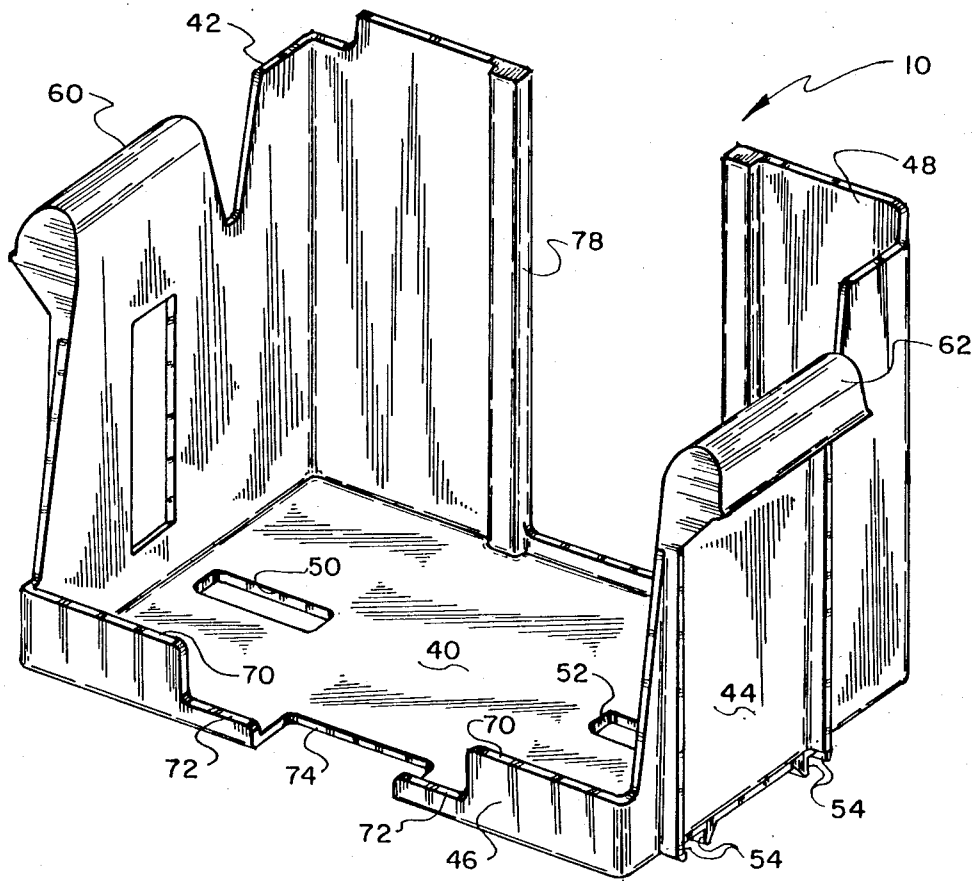
FIG. 2 is an enlarged perspective view of the tote box.
Figure 4:
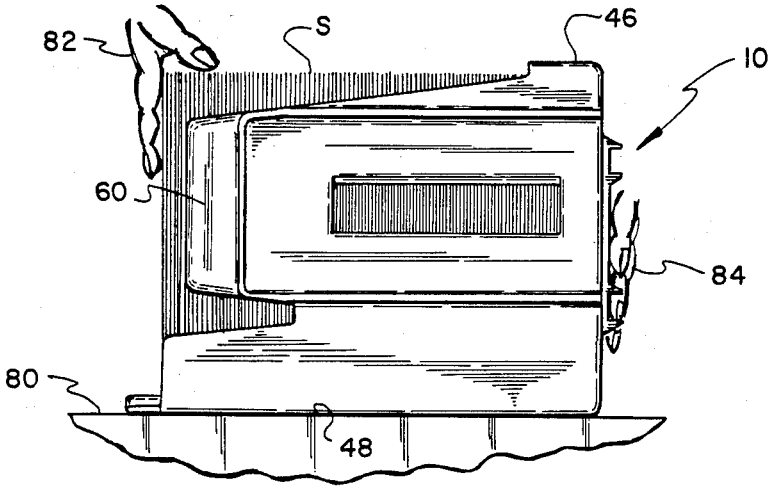

As best shown in FIG. 3 for end wall 42, the end walls preferably have ribs 64 and 66 that extend vertically from the bottom of the box to the respective handle to stiffen the end walls. This permits the end walls to be somewhat thinner without significant loss of rigidity.

Front wall 46 has an upper edge 70 that is much lower than the top edge of adjacent walls 42, 44 or the back wall 48. This permits sheets S to be swung into the tote box over the top edge 70 of the front wall by means of the arm 26 and jaws 28, 30 as generally explained hereinbefore in connection with FIG. 1. A U-shaped opening 72 in the center portion of the front wall 46 permits the jaw 28 and lower portion of arm 26 to be swung through the tote box. Opening 72 extends from the top edge of wall 46 to a position near the bottom wall 40. In addition, a recess 74 is provided in the lower center of the front wall 46 and in the adjacent portions of the bottom wall 40 to facilitate manual grasping and removing of stacks of sheets S from box 10 without inversion of the box, if desired.

Back wall 48 projects from the bottom wall 40 by a distance greater than the end walls 42, 44 or the front wall 46. The height of back wall 48 can vary, depending upon the intended application of the tote box. By way of example, a wall height of about twelve to fourteen inches has been found satisfactory for a tote box that receives two to three thousand discrete sheets delivered by a finisher 12.

A deep, U-shaped opening 78 is provided in the top center of back wall 48. Opening 78 extends from the top edge of the back wall to a position adjacent the bottom wall 40 and spaced from the bottom wall by a distance substantially equal to the spacing between the bottom wall and the bottom edge of opening 72 in the front wall 46. Opening 78 enables arm 26 and the associated structure to move through the back wall when the elevator 14 is in a fully raised position so that copy sheets S can be delivered just over the top edge 70 of the front wall 46 onto the bottom wall 40.

The tote box 10 is loaded into the finisher 12 by withdrawing platform 18 relative to elevator 14 and then placing the tote box on the platform. End wall 42 is positioned at the front of the finisher, and front wall 46 at the right side as viewed in FIG. 1. The tote box is precisely located on the platform in a lateral direction by registering the pairs of rails 54 with the corresponding recesses 18 in the platform. Then the platform with the box thereon is moved back into the finisher where openings 72 and 78 are aligned with the path of movement of the arm 26.

With the reproduction apparatus and finisher 12 being operated, sheets S are delivered seriatim to the hopper 24 and jogged into alignment on the hopper. Periodically arm 26 is moved to a position where the jaws 28, 30 straddle the sheets in the hopper, and cylinder 32 is operated so that the jaw 30 moves toward jaw 28 to grip a group of the sheets. Then the arm is swung from a position adjacent the hopper through the solid line position shown in FIG. 1 to its dotted line position and the jaws are released while the arm is over the tote box to enable the sheets S to drop into the box and be supported by the bottom wall 40 of the box. As explained before, the top edge 70 of the front wall 46 of the box is sufficiently low to enable movement of the sheets by arm 26 over the top edge 70 of the wall even when the elevator 14 is in its raised position. Also, the opening 72 in the front wall 46 and the opening 78 in the back wall 48 provide space needed for the arm 26 to swing over the bottom 40 of the tote box between a position adjacent the hopper and the dotted line position. As sheets accumulate on the bottom 40 of the box, the elevator 14 of the finisher is lowered so that the top of the stack of sheets S resting on the bottom wall 40 is always below the path of movement of arm 26 and new sheets being delivered to the tote box by arm 26.

When the job run is completed, or when the box 48 is substantially full, platform 16 is withdrawn from the finisher and the box is removed by an operator grasping the handles 60 and 62 and lifting upwardly to raise the rails 54 out of the recesses 18 in the platform. Because the handles are near front wall 46, the tray tilts toward the rear wall 48 and sheets in the tray rest against wall 46. Then the tote box can be placed on a surface 80 of a table or work station with the rails 54 supporting the box on the surface in the manner illustrated in FIG. 3.

With the tote box resting on surface 80, the box can be emptied of the sheets S. If only a few sheets are present in the box, the operator can reach through the opening 74 in the front and bottom walls of the box and simply lift upwardly to remove the sheets over the top edge 70 of the front wall. However, when the box is used with an electronic printer job runs can be quite long and two or three thousand sheets may be accumulated in the box 10. In addition, as pointed out previously, the first page of the job run may typically be at the bottom of the stack of sheets with its printed face facing downwardly toward the bottom wall 40 of the box. In this case it is most desirable to easily unload the large stack of sheets by following the steps illustrated in FIGS. 3—5.

Figure 5:
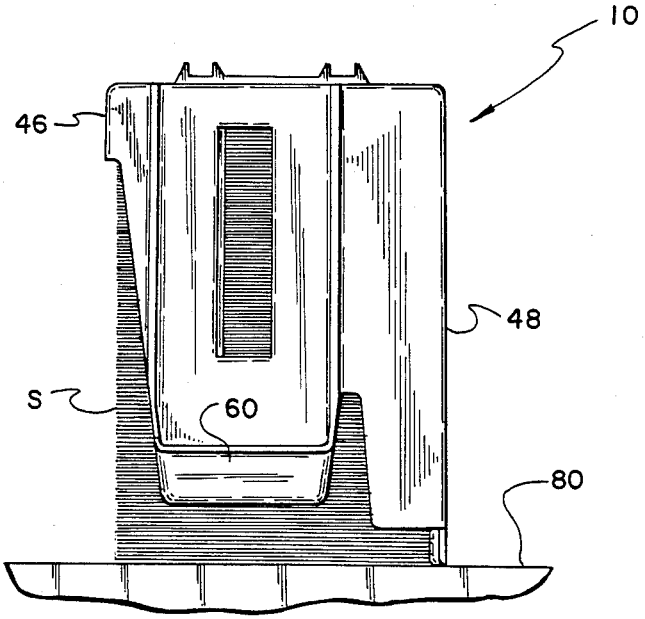

With the box in the position shown in FIG. 3, the operator can use one hand 82 to grip the top edge of the back wall 48 and the fingers of the other hand 84 can be placed under the front wall 46 and along the bottom surface of bottom wall 40 and with the thumb of hand 84 alongside front wall 46. Ribs 54 elevate the box above surface 80 by a distance sufficient to enable the fingers of hand 84 to reach under the box. Then the box is swung in a counterclockwise direction as viewed in FIG. 3 until it reaches the FIG. 4 position where the back wall 48 rests against the surface 80. As this occurs, the hand 82 and adjacent portions of the arm hold the stack of sheets S from falling out of the open top of the tote box. Then hand 82 is moved to the position shown in FIG. 4 where it holds the edge of the stack of sheets S and prevents the sheets from falling out of the open top of the box. The fingers of the other hand 84 are placed in one of the openings 50, 52 of bottom wall 40. Then the tote box is swung another ninety degrees in a counterclockwise direction until the tote box and sheets are located in the position illustrated in FIG. 5. In FIG. 5 the box is completely inverted from the position illustrated in FIG. 3 and the sheet S that was at the top of the stack in FIG. 3 now rests directly on the surface 80. At this time the tote box 10 can be lifted away from the stack of sheets S by using the handholds formed by the openings 50, 52. This leaves the first page of the document on top of the stack with that first page facing upwardly.

Box 10 conveniently receives large stacks of sheets S that are delivered in a face down orientation. With the combination of handles and handholds, etc. on the box, inversion of the box to unload the box and properly orient the stack of sheets S is greatly simplified. Moreover, the openings 72 and 78 in the box permit it to be used with a conventional finishing apparatus in which the arm 26 is moved along a path through the box and over bottom wall 40.

While the invention has been described in detail with particular reference to the preferred embodiment thereof, it will be understood that variations and modifications can be effected within the spirit and scope of the invention.

I claim:

1. A tote box for receiving a stack of discrete sheets and for inverting and removing the stack from the box, the box comprising:

a bottom wall having a surface on which sheets are stacked, means on the bottom wall defining a handhold by which a person can grasp and move the tote box, first and second side walls projecting upwardly from the bottom wall in generally parallel planes, a pair of handles secured to the first and second walls and spaced from the bottom wall, third and fourth side walls projecting upwardly from the bottom wall in generally parallel planes that are substantially perpendicular to the first and second walls, the third wall being shorter than the fourth wall with the top of the third wall being sufficiently low to enable sheets to pass above the top of the third wall as they are delivered into the tote box, whereby a stack of sheets resting on the bottom wall of the tote box and between the other walls can be unloaded by first turning the box approximately ninety degrees so that the box rests on the fourth wall, and then using the handhold on the bottom wall to turn the box another ninety degrees so that the box is completely inverted, and then lifting the box away from the stack.

2. A tote box as set forth in claim 1 further comprising an opening in each of the third and fourth walls, both openings extending from the top edge of the respective wall to a position adjacent the bottom wall to permit an arm delivering sheets to the tray to move through the tray over the bottom wall.

3. A tote box as set forth in claim 1 wherein the handles on the first and second walls are nearer to the third wall than to the fourth wall so that when the box is lifted using the handles the box tends to tilt about the handles to urge sheets in the box toward the fourth wall.

4. A tote box as set forth in claim 1 further comprising means on the bottom wall for elevating the bottom wall above a supporting surface by a distance sufficient to place the fingers of a hand under the bottom wall so that the box can be easily inverted.

5. A tote box as set forth in claim 1 wherein the first and second walls are substantially higher than the third wall and approximately the same height as the fourth wall.

6. A tote box as set forth in claim 1 wherein the handhold comprises an elongate opening through the bottom wall.

7. A tote box for use with finishing apparatus having an arm for delivering sheets to the box, the box comprising:

a bottom wall having a flat surface on which sheets are stacked, an elongate opening through the bottom wall defining a handhold by which a person can grasp and move the tote box, a plurality of rails on the outer surface of the bottom wall for locating the box in the finishing apparatus and elevating the bottom wall above a supporting surface when the box is removed from the finishng apparatus, first and second side walls projecting upwardly from the bottom wall in spaced and generally parallel planes, third and fourth side walls projecting upwardly from the bottom wall in generally parallel and spaced planes that are substantially perpendicular to the first and second walls, the third wall being shorter than the first, second and fourth walls with the top of the third wall being sufficiently low to enable sheets to pass above the top of the third wall as they are delivered into the tote box from the finishing apparatus, the third and fourth walls each having an opening extending from the top edge of the respective wall to a position adjacent the bottom wall to provide a path through the box for the arm of the finishing apparatus, a pair of handles on the first and second walls, the handles being adjacent the top edge of the respective wall and being nearer the third wall than the fourth wall so that when the box is lifted by the handles there is a tendency for the box to tilt about the handles to urge sheets in the box toward the fourth wall, whereby a stack of sheets delivered to the bottom wall of the tote box by the finishing apparatus can be unloaded by removing the box from the finishing apparatus to a supporting surface and then first turning the box approximately ninety degrees so that the fourth wall rests on the surface, and then using the handhold on the bottom wall to turn the box another ninety degrees so that the box is completely inverted, and then lifting the box away from the stack.

* * * * *